United States Patent [19]

Ondris et al.

[11] 4,424,897

[45] Jan. 10, 1984

[54] DISPLAY CARTON AND BLANK THEREFOR

[75] Inventors: Joseph F. Ondris, Murray Hill, N.J.; Felix Korn, Forrest Hills, N.Y.

[73] Assignee: Bristol-Myers Company, New York, N.Y.

[21] Appl. No.: 357,368

[22] Filed: Mar. 12, 1982

[51] Int. Cl.[3] ..... B65D 5/50; B65D 25/00

[52] U.S. Cl. ..... 206/45.14; 206/45.31; 206/45.19

[58] Field of Search ..... 206/45.14, 45.15, 45.19, 206/45.33, 45.34, 45.31, 583; 229/27

[56] References Cited

U.S. PATENT DOCUMENTS

| | | | |
|---|---|---|---|
| 3,158,259 | 11/1964 | Pantalone | 206/45.14 |
| 3,592,338 | 7/1971 | Hanson et al. | 206/45.19 |
| 4,113,086 | 9/1978 | Forbes, Jr. | 206/45.14 |
| 4,117,924 | 10/1978 | Growney | 206/45.14 |

*Primary Examiner*—William T. Dixson, Jr.

*Assistant Examiner*—Brenda J. Ehrhardt

*Attorney, Agent, or Firm*—Gabriel P. Katona; Irving Holtzman; George A. Mentis

[57] ABSTRACT

A display carton formed from a single blank of paperboard or the like having an outer carton structure and an inner product compartment. The outer carton structure has spaced outer front and rear walls separated from each other by a pair of outer carton side walls and said inner compartment comprises a pair of inner side wall panels and a rear panel. The inner compartment is secured to said outer carbon structure so that rear inner compartment panel is not secured to said rear outer carton wall and the inner compartment side panels are not secured to said outer carton side walls so that when the carton is squared and erected said inner compartment may be erected independently of the squaring of said outer carton by snapping said inner compartment into its erected position. A self-centering beam is also provided to insure the automatic centering of the inner compartment.

7 Claims, 12 Drawing Figures

FIG. 9
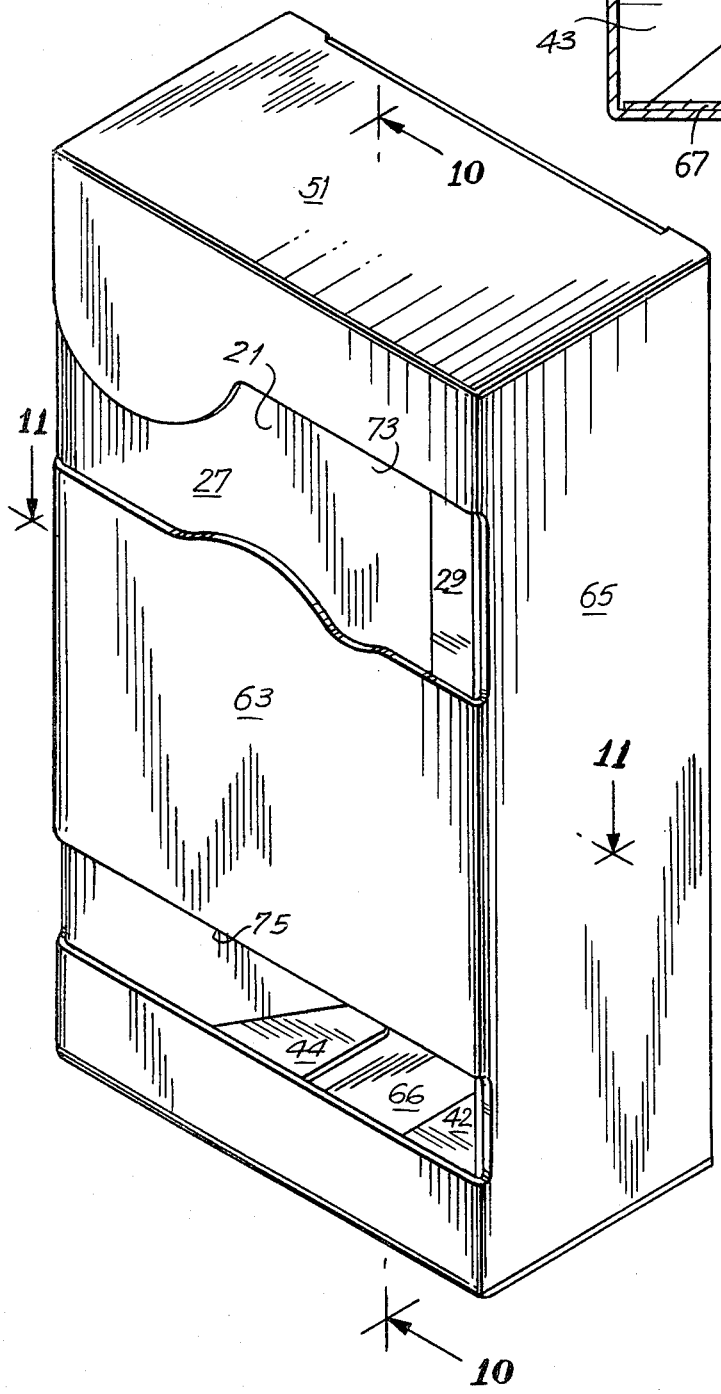
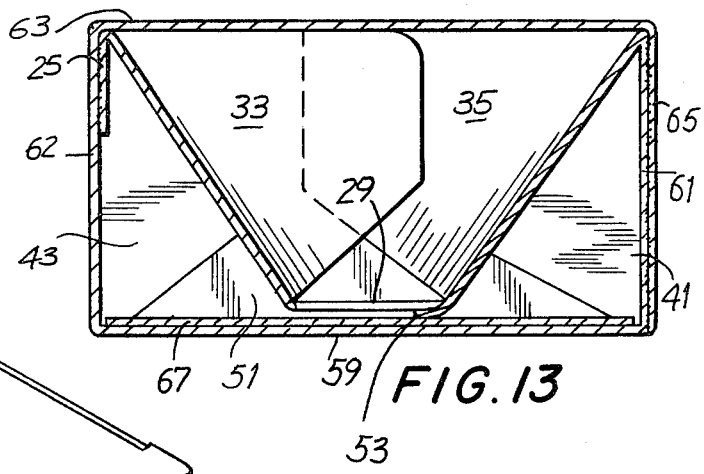
FIG. 13
FIG. 10
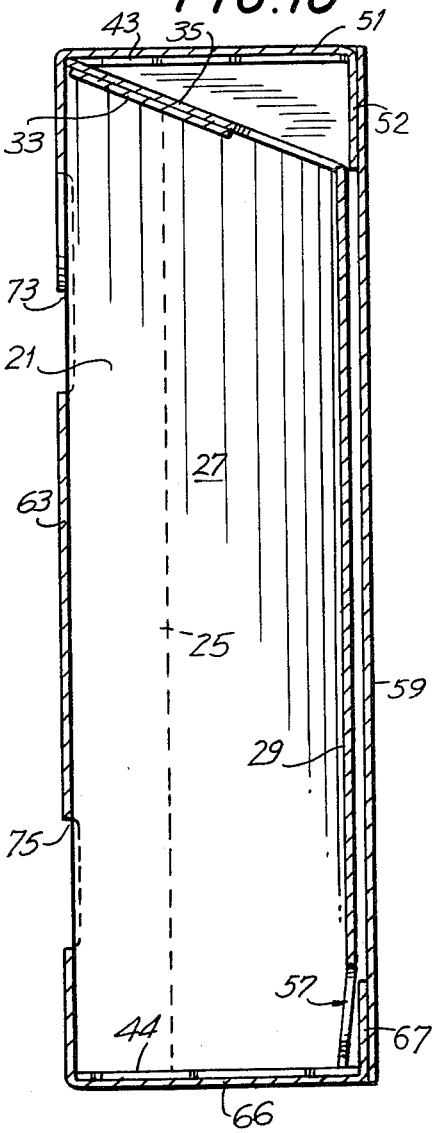

DISPLAY CARTON AND BLANK THEREFOR

This invention relates to a display type carton designed particularly to hold a product container and to unitary cut and scored blanks from which said display carton may be erected. The blanks are usually made of paperboard and the container that may be packaged therein may be any of a variety of containers, including bottles, tubes, etc.

Display cartons of the aforesaid general type have been known for a long time and have been widely used in a variety of industries. Some typical examples of such cartons are shown in the U.S. Pat. Nos. 3,158,259 (Pantalone); 4,113,086 (Forbes Jr.), and 4,117,924 (Growney). As will be apparent from the following discussion, the present display carton has several advantages over these prior art devices.

The display cartons of the prior art generally comprise an outer carton structure and an inner product holding compartment or pocket. Moreover, to hold the inner pocket in place and to center the same, it was customary to glue one surface of the pocket to the inside of one of the panels of the outer carton structure. Usually, the back panel of the inner compartment or pocket is glued to the inner surface of the back panel of the outer carton structure.

The need to glue the back panel of the inner compartment to the back panel of the outer container structure has several distinct disadvantages. In the first place, this is an additional processing step which adds to the cost of making the carton. Secondly, this further complicates the assembling procedure for the carton.

It has now been found that the need to glue the back panel inner compartment to the back wall of the outer carton structure may be dispensed with by providing a snap-in suspended inner compartment described in more detail below. In addition, the problem of centering the inner compartment when the carton is erected is taken care of by providing a self-centering beam as also described in more detail below.

It is accordingly an object of the present invention to provide a display carton having an inner compartment or pocket and an outer carton structure in which the back panel of the inner compartment is not glued to the back wall of the outer carton structure.

It is also an object of the present invention to provide a display carton described in the above object with the inner compartment provided with a self-centering feature.

Other and more detailed objects of this invention will be apparent from the following description, claims and drawings.

In the attached drawings, in which the same numerals designate the same structure in the various views:

FIG. 9 is a perspective view of carton embodied in the present invention erected from the blank shown in FIG. 1;

FIG. 10 is a longitudinal cross sectional view of the modification shown in FIG. 9 taken along line 10—10 of FIG. 9;

Figure 11:
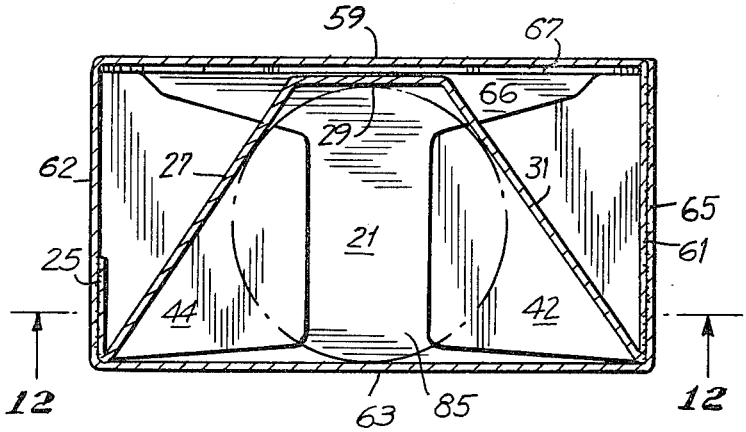
FIG. 11 is a horizontal cross sectional view of the modification of this invention shown in FIG. 9 taken along line 11—11 of FIG. 9 with a container in place shown in dotted line.
Figure 12:
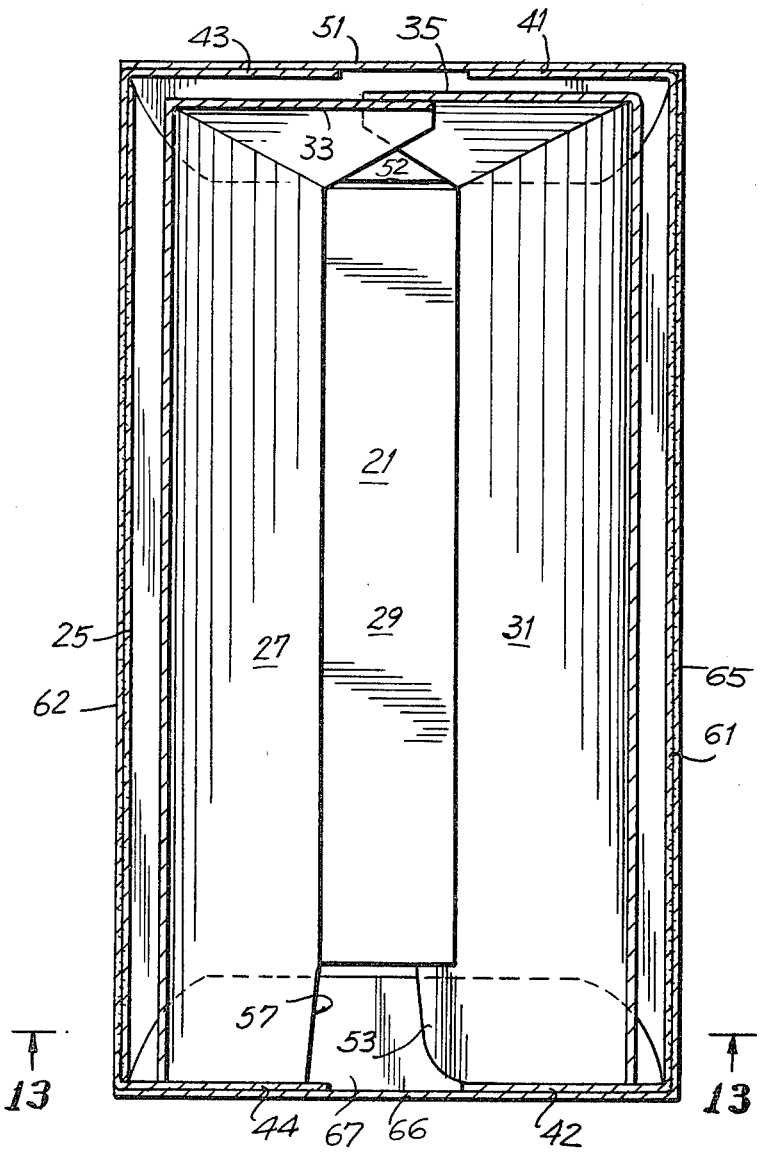

FIG. 12 is a longitudinal sectional view of the modification of this invention shown in FIG. 11 taken along line 12—12 of FIG. 11; and FIG. 13 is a horizontal cross sectional view taken along line 13—13 of FIG. 12 showing the position of the self-centering beam 53 when the carton is in its erected position.

Figure 1:
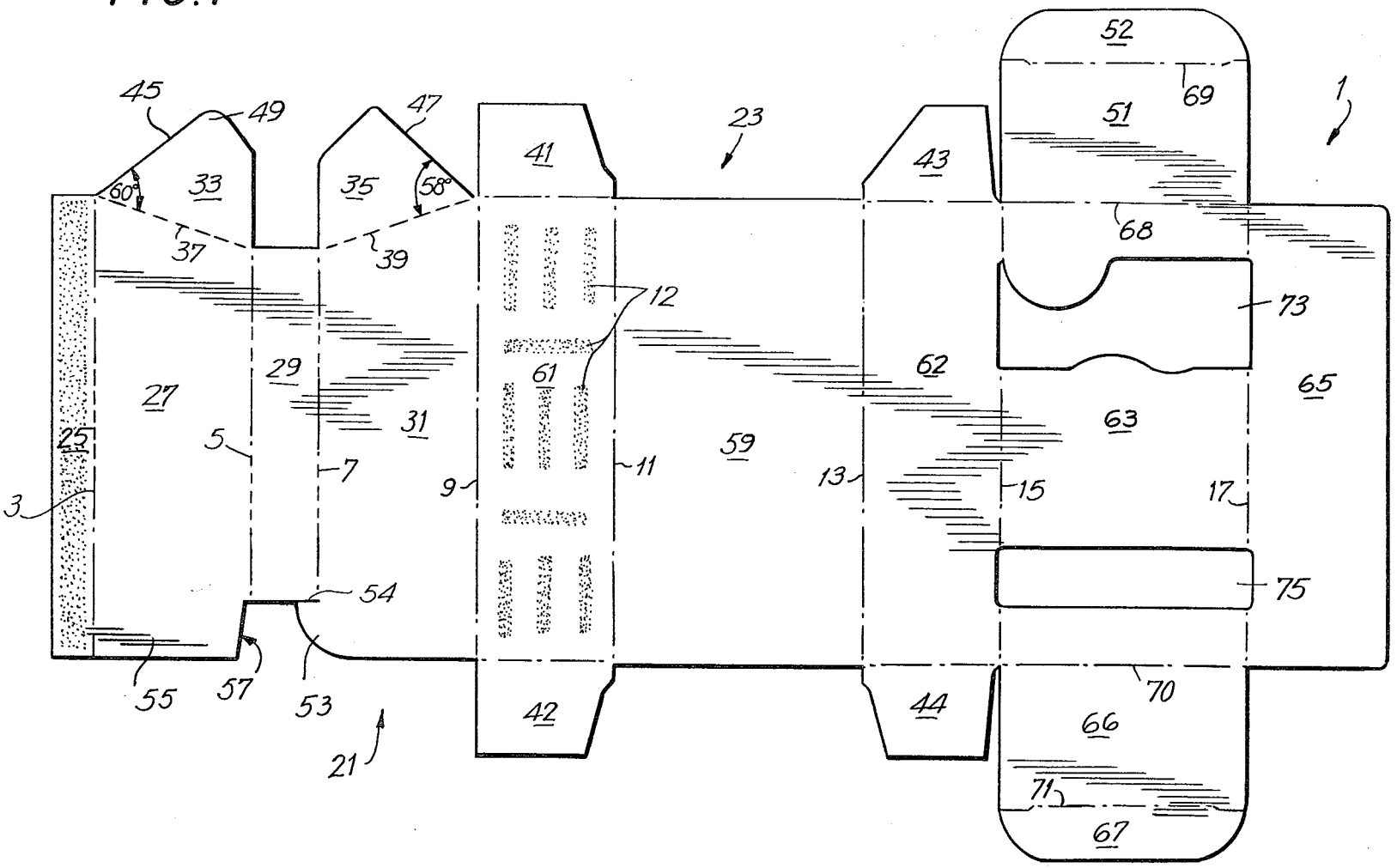
FIG. 1 is a plan view of the upper side of a carton blank embodied in the present invention.

Referring to FIG. 1 a carton blank is shown generally at 1 which may be formed of paperboard or some other foldable sheet material. Blank 1 is provided with a plurality of longitudinally extending scored fold lines 3, 5, 7, 9, 11, 13, 15 and 17 described in more detail below. Blank 1 is divided into an article holding inner compartment section 21 and an outer carton section 23 along fold line 9.

Inner compartment section 21 comprises a gluing strip 25, a left panel 27, a rear panel 29 and a right panel 31. These are folded along fold lines 5, 7 and 9 to form a pocket for holding the article to be contained in the carton in a manner described in more detail below.

Extending upwardly from panels 27 and 31 respectively of inner compartment section 21 are a pair of cantilevered flaps 33 and 35. These are designed to rotate inwardly around fold lines 37 and 39 when the assembled carton blank is erected and squared and dust flaps 41 and 43 are closed. To permit flaps 33 and 35 to be rotated inwardly without interference and to allow them to assume an overlapping relationship when they are folded inwardly, fold lines 37 and 39 are disposed at an angle with respect to the horizontal. These angles are generally about the same size and may vary somewhat depending on the height of the product container. In a typical case this will be about 17°.

Furthermore, the outer margins 45 and 47 of cantilevered flaps 33 and 35 will form an angle with respect to fold lines 37 and 39 respectively. To insure that the proper overlapping relationship is obtained when flaps 33 and 35 are rotated inwardly, these angles are made so that they are slightly different in angular measurement. In a preferred embodiment, the angle that margin 45 makes with fold line 37 is about 60°; whereas, the angle that margin 47 makes with fold line 39 is about 58°.

As will be described in more detail below, flaps 33 and 35 when folded inwardly will form the roof of the inner compartment section when the carton is squared and erected. Since these flaps are not anchored, they provide a cushion for the container during shipment of the products. This serves to reduce breakage of the container particularly when the containers are made of glass or the like.

The topmost edge 49 of cantilevered flap 33 is shaped so as to have a relatively large radius. This is designed in this fashion so that it would not interfere with the closing of flap 51 of the outer carton 23. A suitable radius for edge 49 is about 7/16". Cantilevered flap 35, on the other hand, at its topmost edge is preferably angular and is not provided with a radius. This is done in order to provide as much bulk of material which should strengthen the inner compartment that holds the product container.

It is a feature of the present invention that left and right panels 27 and 31 and rear panel 29 of the inner compartment are not glued to any of the surfaces of the outer carton structure. This is significant is that there is less potential for rejections due to glue squeeze out when the carton is assembled. Furthermore, fewer gluing operations contribute to the lower cost for the cartons. Moreover, less resistance is offered to the cartoning machine at high speeds when the assembled cartons are being set up into tubes.

To insure that the inner compartment is automatically centered when the carton is squared and erected, panel 31 is provided with a self-centering beam 53. Beam 53 is formed as a horizontal extension of the lower portion of panel 31 and may be made by cutting a horizontal slit 54 into the bottom portion of panel 31. The inner margin of beam 53 is preferably formed with a radius which typically is about a $\frac{5}{8}''$ radius. The horizontal dimension of beam 53 is greater than the corresponding horizontal dimension of the lower section 55 of panel 27. Because of this difference in horizontal dimension when the carton is erected and squared, the inner margin 57 of lower section 55 is spaced somewhat from the inner surface of rear wall 59 of outer carton 23; whereas, the inner margin of beam 53 engages said inner surface of rear wall 59. This serves to center the inner compartment.

Outer carton section 23 consists of right side panel 61, a back panel 59, a left side panel 62, a front panel 63 and a wrap around panel 65. Right side panel 61 is provided with upper and lower dust flaps 41 and 42 and embossed indentations 12 which serve as a gluing surface when the carton is assembled. The latter is secured to the under surface of wrap around panel 65 to which glue is applied when the carton is assembled. Left side panel 62 is also provided with dust flaps 43 and 44 and are assembled as described in more detail below.

Extending upwardly from front panel 63 is the upper outer carton flap 51 which is closed by folding it around fold line 68. Flap 51 is provided with a tab 52 that is tucked into the assembled carton container by folding it around fold line 69. A similar lower carton flap 66 is also provided having a tab 67. Flap 66 is closed by folding it around fold line 70. Also tab 67 is tucked into the assembled container by folding it around fold line 71.

In the modification illustrated, an upper window 73 and a lower window 75 are cut in front wall 63. These make it possible to see the container held within the carton after the container is loaded into the carton and the carton is closed.

Figure 2:
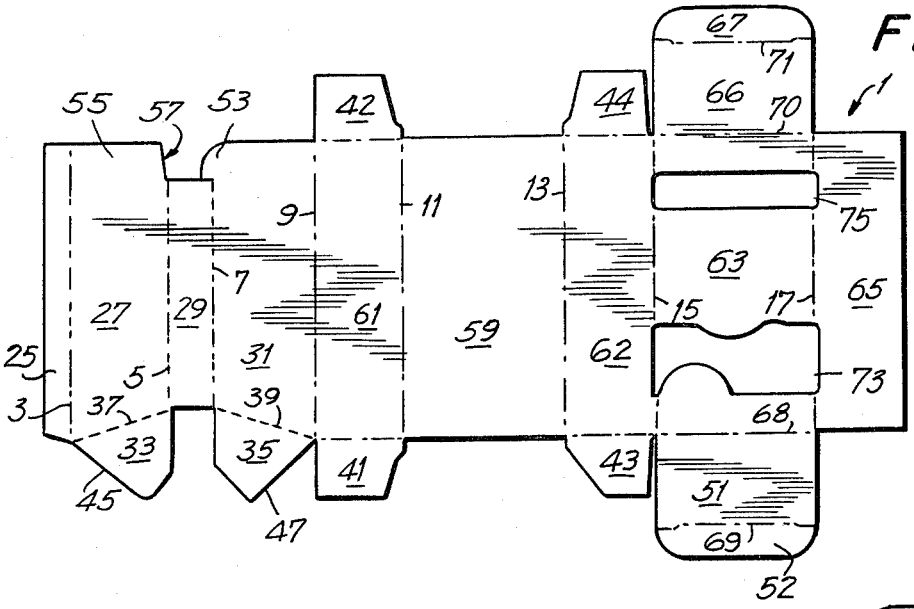
FIG. 2 is a plan view of the flip side or underside of the carton blank shown in FIG. 1, said blank being flipped around its long axis.
Figure 3:
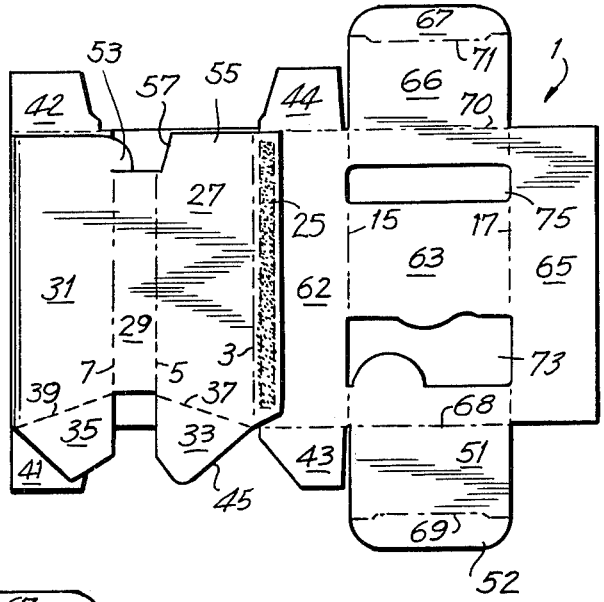
FIGS. 3–7 are plan views of the carton blank shown in FIG. 2 showing the various steps in the folding and gluing operation employed in forming a carton embodied in the present invention.

The procedure for folding and gluing the carton of this invention may best be understood with reference to FIGS. 2 through 7. FIG. 2 is a plan view of the underside of a carton blank showing the various fold lines and is the starting condition of the carton before it is folded. In the first fold, the entire section consisting of panels 25, 27, 29 and 31 is folded from left to right around fold line 9. The result of this fold is seen in FIG. 3 wherein the upper side of panels 25, 27, 29 and 31 can now be seen. In this folded position, the underside of panels 61 and 59 are covered and panel 62 is partly covered.

Figure 4:
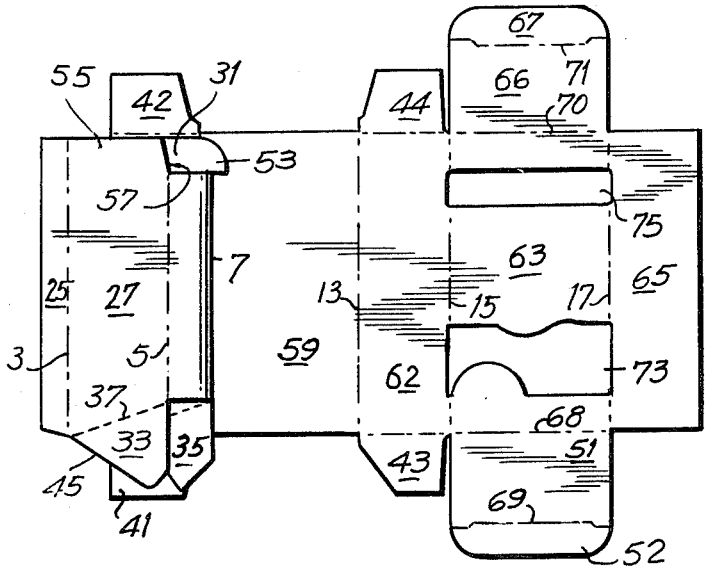

In the next step, panels 25, 27 and 29 are folded back as a unit from right to left around fold line 7. The result of this fold is best seen in FIG. 4. In this fold, the underside of panels 25, 27 and 29 are now visible.

Figure 5:
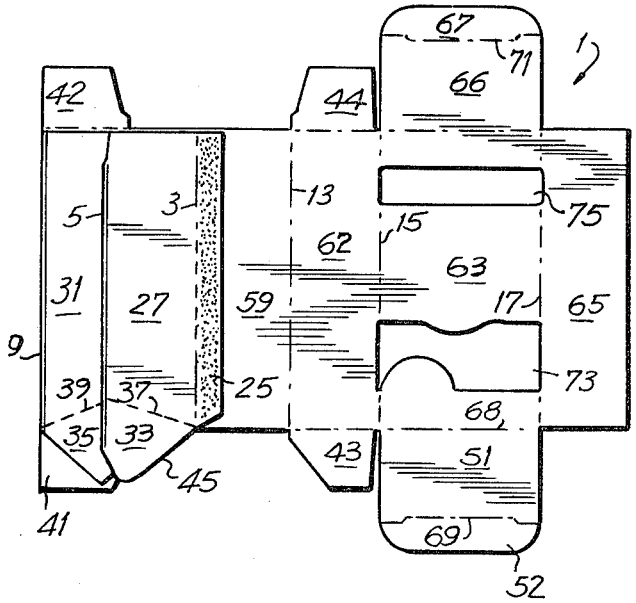

In the next step, panels 25 and 27 are folded as a unit from left to right around fold line 5. The result of this fold is best seen in FIG. 5. In this view, the upper sides of panels 25, 27 and 31 are visible. Panel 25 is a glue panel and the glue is applied to upper surface of this panel in this stage of the folding operation.

Figure 6:
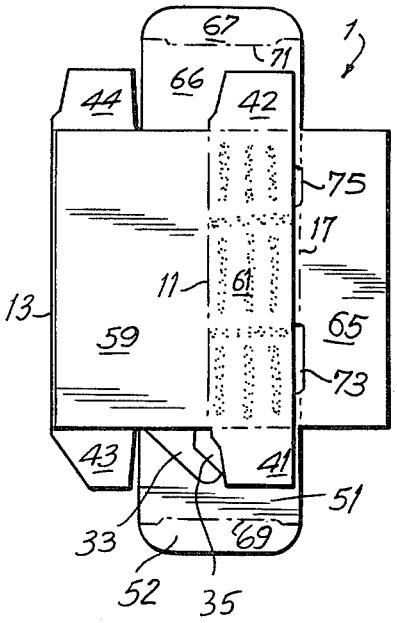
Figure 7:
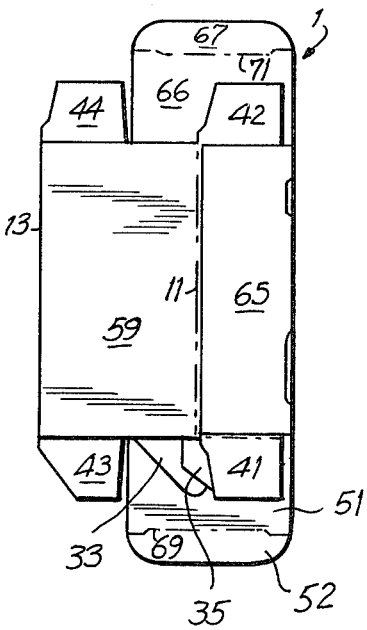

Following this, panels 25, 27, 29, 31, 61 and 59 in the folded condition shown in FIG. 5 are then folded from left to right around fold line 13. The result of this fold is best seen in FIG. 6. This is held down firmly to permit the gluing of the upper side of glue panel 25 to the underside of panel 62 adjacent the right hand margin of panel 62.

The last step in the folding and gluing operation involves applying glue to panel 65 in the folded condition shown in FIG. 6. Panel 65, with the glue applied to it, is then folded from right to left around fold line 17. This is pressed down to assure that panel 65 becomes glued to panel 61.

During the folding operation, fold lines 11 and 15 are also pre-broken. This is done to facilitate the squaring and the erecting of the carton as described in more detail below.

Figure 8:
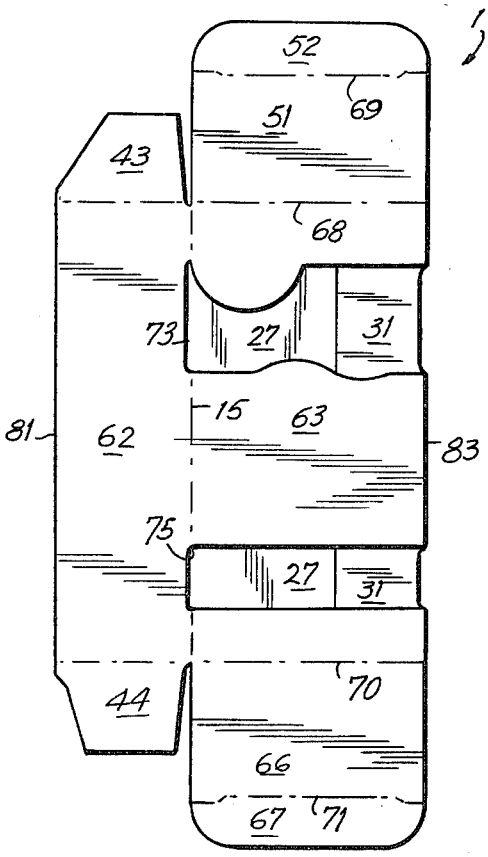
FIG. 8 is a plan view of the front side of the assembled carton ready to be squared and erected.

FIG. 8 shows the front view of a carton of this invention after the folding and gluing operation has been completed but before the carton has been erected for loading it with a container. To erect the carton, it is delivered to an erecting station at which margin 81 is maintained in a fixed position while pressure is applied to margin 83. This causes left panel 62 and the glued right panel 61, with its overlying wrap around panel 65 (not shown in this view) to rotate around their fold lines so that they assume a position that is at about 90° with respect to the plane of the drawing in FIG. 8. Inward pressure is then applied to left side panel 27 of the inner compartment 21 until it snaps inwardly thereby erecting inner compartment 21.

When left side panel 27 is snapped inwardly and the inner compartment 21 is formed, self-centering beam 53 of said panel 31 is brought into engagement with the inner surface of the back wall 59 and flap 67 of the outer carton structure 23. This serves to automatically center the inner compartment 21.

The positioning of self-centering beam 53 when the carton is erected is perhaps best seen in FIGS. 12 and 13. Beam 53 is directed inwardly and backwardly when the carton is erected. As seen in FIG. 13, it projects further back than the back wall 25 of the inner compartment and engages the back wall of the outer carton. In this position, self-centering beam 53 may be slightly bent.

In the preferred form of this invention, the product container 85 shown in dotted line to be inserted into the inner compartment 21 is loaded through the bottom of the carton. This container is fed into the carton through the bottom opening therein and then the upper end of the carton is closed. The loaded container assumes the position in the inner compartment 21 as shown in FIG. 11.

To close the upper end of the carton, it is preferred that dust flap 43 first be folded inwardly. In the course of this operation, flap 43 also engages the outer surface of cantilevered flap 33 and urges it inwardly and downwardly. Dust flap 41 is then also folded inwardly which causes it to engage cantilevered flap 35 and also urges this downwardly and inwardly. This brings cantilevered flap 35 into overlapping relationship with cantilevered flap 33 and together these form a cushioned roof for inner compartment 21. Closing the upper end of the carton is completed by folding carton flap 51 inwardly and tucking in tab 52.

Closing of the lower end of the carton is accomplished in a fashion similar to that described above in connection with the closing of the upper end of the carton. Dust flaps 44 and 42 are folded inwardly followed by the folding inwardly of lower outer carton flap 66. This is completed by tucking tab 67 into the container.

In an alternative procedure, the product container may be top loaded into the carton. In this event, the product container is fed into compartment 21 through the upper opening in the carton. The upper and lower openings in the carton are then closed in a manner equivalent to that described above in connection with the bottom loading procedure.

The assembled carton is shown in FIGS. 9 through 12. As seen best in FIG. 11, when inner compartment 21 is formed after snapping it into position by applying pressure on panel 27, an inner compartment is formed having side walls 27 and 31 that slope inwardly and backwardly until they reach the side margins of back panel 29. The cushioned roof of this inner compartment is formed by overlapping cantilevered flaps 33 and 35. This is best seen with respect to FIG. 10 and FIG. 12 of the drawings.

As indicated above, the inner compartment 21 is not glued to the back 59 of the outer carton structure. It is, however, glued to the inner surface of left side panel 62 of the outer carton structure. This is done by gluing glue strip 25 to left panel 62. This relationship is best seen in FIGS. 11 and 13 of the drawings.

Although the invention has been described with reference to specific forms thereof, it will be understood that many changes and modifications may be made without departing from the spirit of this invention.

What is claimed is:

1. A one-piece blank for a carton assembly having an outer carton structure and an inner compartment; said blank being provided with a front carton wall having end closure flaps attached at each end thereof, a glue panel contiguous with said front carton wall along one fold line and extending to one side of said front carton wall, and extending from the other side of said front carton wall and successively joined thereto by parallel substantially vertical fold lines:

(a) a first side carton wall;
(b) a back carton wall;
(c) a second side carton wall;
(d) a first inner compartment side panel;
(e) an inner compartment back panel;
(f) a second inner compartment side panel; and
(g) a glue panel one of said inner compartment side panels being provided near one of its margins with self-centering beam directed toward said inner compartment back panel.

2. A one-piece blank according to claim 1 in which said self-centering beam is located on said first inner compartment side panel.

3. A one-piece blank according to claim 2 in which said first inner compartment side panel is provided with a first cantilevered flap extending outwardly from the margin of said first inner compartment side panel remote from said self-centering beams and said second inner compartment side panel also being provided with a second cantilevered flap that extends outwardly from the corresponding margin of said second inner compartment side panel; whereby said first and second cantilevered flaps may cooperate with each other to form the roof of said inner compartment when said carton is assembled.

4. A one-piece blank according to claim 3 in which fold lines are provided on said first and second inner compartment side panels to demark said side panels from said cantilevered flaps; said fold line forming an angle with the horizontal which is slightly different for each fold line.

5. A one-piece blank according to claim 4 in which the outer margin of one of said cantilevered flaps is provided with a curvature; whereas, the outer margin of said other cantilevered flap is angular in outline.

6. A one-piece blank according to claim 5 in which each of said carton side walls is provided with dust flaps that are oriented in the same general direction as said cantilevered flaps.

7. In a carton of generally parallelopiped configuration when squared and erected formed from a single blank of paperboard or the like comprising an outer carton structure and an inner compartment; said outer carton structure having spaced outer front and rear walls separated from each other by a pair of outer carton side walls and said inner compartment comprising a pair of inner side wall panels and a rear panel; the improvement which comprises securing said inner compartment to said outer carton structure so that said rear inner compartment panel is not secured to said rear outer carton wall and said inner compartment side panels are not secured to said outer carton side walls whereby when said carton is squared and erected said inner compartment may be erected independently of the squaring of said outer carton by snapping said inner compartment into its erected position, one of said inner compartment side panels is provided with means for self-centering said inner compartment when said inner compartment is erected, and said self-centering means comprises a self-centering beam that extends inwardly from the lower inner margin of one of said inner compartment side panels when the said inner compartment is erected.

* * * * *